US006487887B2

(12) United States Patent
Yamada

(10) Patent No.: US 6,487,887 B2
(45) Date of Patent: Dec. 3, 2002

(54) WORKING APPARATUS AND METHOD FOR BAND BLADE

(75) Inventor: Toshio Yamada, Higashiosaka (JP)

(73) Assignee: Suntex Co., Ltd., Higashiosaki (JP)

( * ) Notice: Subject to any disclaimer, the term of this patent is extended or adjusted under 35 U.S.C. 154(b) by 0 days.

(21) Appl. No.: 09/791,821

(22) Filed: Feb. 26, 2001

(65) Prior Publication Data

US 2001/0017074 A1 Aug. 30, 2001

(30) Foreign Application Priority Data

Feb. 28, 2000 (JP) ..... 2000-102834
Feb. 5, 2001 (JP) ..... 2001-028745

(51) Int. Cl.[7] ..... B21D 5/00; B21D 28/00

(52) U.S. Cl. ..... 72/294; 72/307; 30/258; 30/349; 83/917

(58) Field of Search ..... 76/107.8, 11; 30/229, 30/258, 349; 83/917, 627, 632, 698.71, 699.11; 72/294, 307

(56) References Cited

U.S. PATENT DOCUMENTS 1,276,256 A * 8/1918 O'Reardon ..... 30/349
1,812,350 A * 6/1931 Lingwood ..... 30/258
3,159,913 A * 12/1964 Winton ..... 30/258
4,033,388 A * 7/1977 Ruegger ..... 72/294
5,271,256 A * 12/1993 Hedrick et al. ..... 72/307
5,463,890 A * 11/1995 Tachibana ..... 72/294
5,771,725 A * 6/1998 Mizukawa ..... 72/294
6,158,264 A * 12/2000 Mizukawa ..... 72/294

* cited by examiner

*Primary Examiner*—Hwei-Slu Payer
(74) *Attorney, Agent, or Firm*—Armstrong, Westerman & Hattori, LLP

(57) ABSTRACT

A working apparatus for band blade provided with a bender for bending a band blade into a predetermined configuration, and a cutter cutting the band blade. The cutter is positioned successively after the bender. And, a working method for band blade having a bending process in which a band blade is bent into a predetermined configuration, and a cutting process in which the band blade is cut. The cutting process is successively conducted after the bending process is previously conducted.

4 Claims, 11 Drawing Sheets

WORKING APPARATUS AND METHOD FOR BAND BLADE

BACKGROUND OF THE INVENTION

1. Field of the Invention

This invention relates to a working apparatus and a working method for band blade.

2. Description of the Related Art

Conventionally, in a working apparatus for a band blade 1, a press progressive die 15 for cutting and notching the band blade 1 is disposed in front of a bender 11, as shown in FIG. 20, or the press progressive die 15 is disposed in front of the bender 11 and a terminal-cutting die 19 is disposed behind the bender 11 as shown in FIG. 21.

The band blade 1 is used for a trimming die for cutting plural products of predetermined configurations by shearing out of single or plural sheets, or coiled material. The band blade 1 is also called Thomson blade. And, the products in the predetermined configurations include extended cigarette boxes, caramel boxes, cardboard boxes, pieces of jigsaw puzzels, etc.

Generally used size (thickness) of the band blade 1 is about 0.7 mm. For this condition, in bending by the bender 11 after the cutting of the band blade 1, when the band blade 1 goes through the press progressive die 15, a guide 13, and the bender 11 having narrow gaps (slits), only little amount of scrap, dust, and flush generated by the cutting of the band blade causes jam, malprogression, and mechanical halt. It is necessary to disassemble the press progressive die 15 and the bender 11 to recover the working, and this frequently generates a loss of production time.

And, in case that the terminal-cutting die 19 is a plier-shaped cutter 46 composed of two pieces having one blade respectively, one of the blades may slide in a direction of an arrow P and the band blade 1 may be bent in a direction of an arrow Q in cutting the band blade 1. For this reason, the plier-shaped cutter 46 has to be made strong as to have a large supporting point 47 and blade width R. In case that the terminal-cutting die 19 disposed behind the bender 11 is the plier-shaped cutter 46 as described above, an end portion C of the band blade 1 as a finished product (refer to FIG. 7) becomes long because the terminal-cutting die 19 is a large device (having large blade width R).

It is therefore an object of the present invention to provide a working apparatus and method for band blade with which the conventional problems above are solved.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
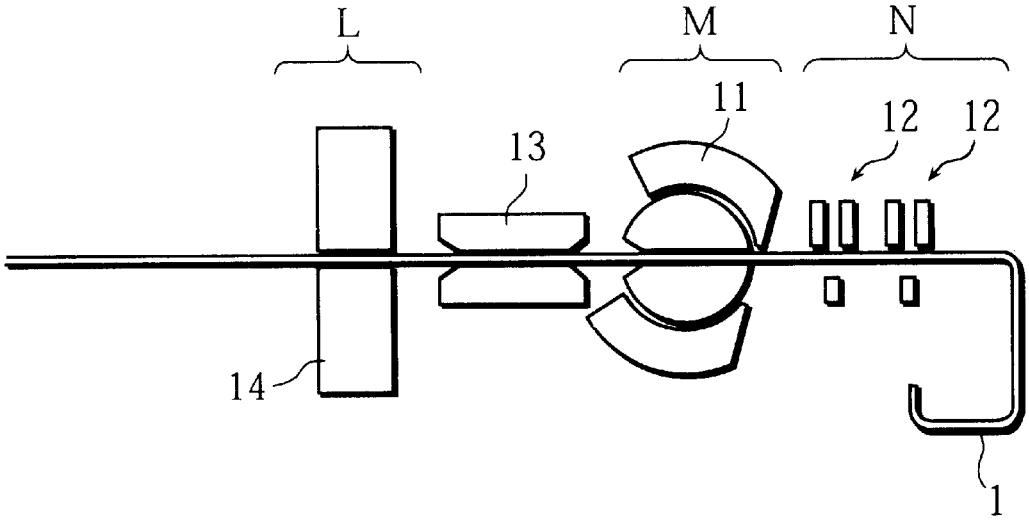
FIG. 1 is a whole view showing an embodiment of the present invention.

FIG. 1 shows a composition of a working apparatus for working and cutting a band blade 1 into a predetermined configuration. As shown in FIG. 1, this working apparatus for band blade is provided with a notching die 14 for making a notch of a predetermined configuration on a predetermined position of the band blade 1, a guide 13 for supporting the band blade 1, and cutters 12 for cutting the band blade 1. And, these devices are disposed successively from an upstream side to a downstream side in order that the notching die 14, the guide 13, the bender 11, and then, the cutters 12.

Figure 7:
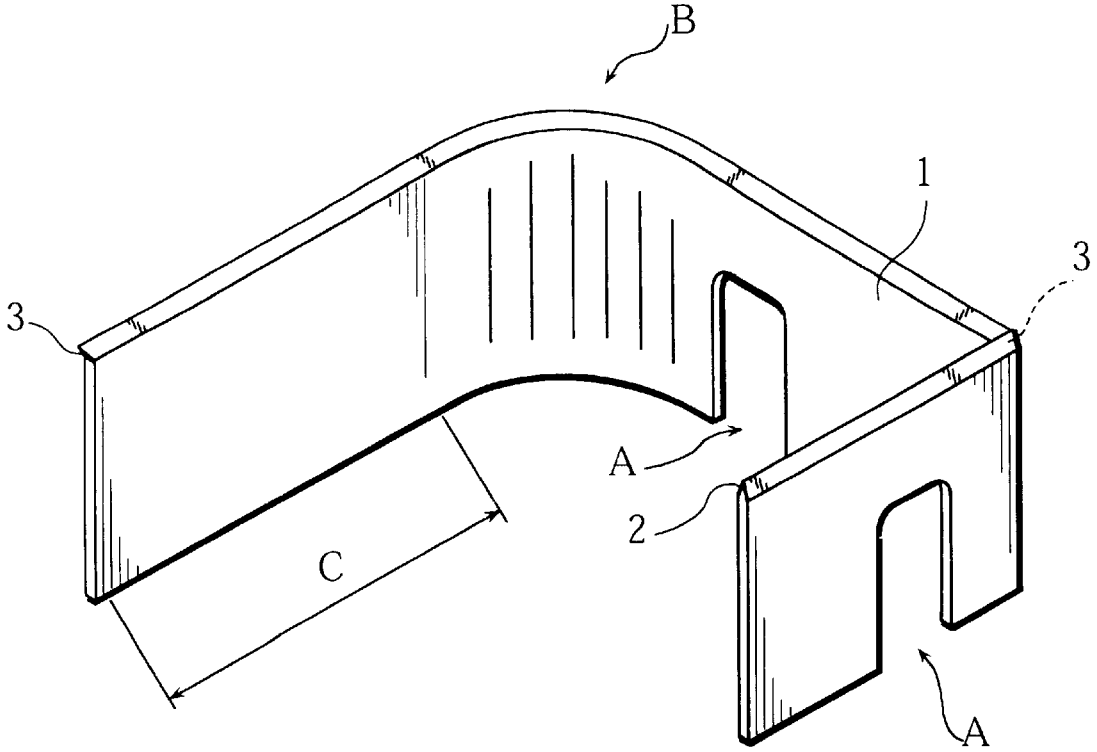
FIG. 7 is a perspective view showing another construction of the band blade.

The band blade 1 of a long strip is inserted to a gap (slit) of the notching die 14 first, press-worked by the notching die having a predetermined configuration to form a notched portion A on the band blade 1 as shown in FIG. 7. Next, the band blade 1 is sent through the guide 13, inserted to a gap (slit) of the bender 11, and bent by the bender 11 into a predetermined configuration (having a bent portion B). Then, the bent-worked band blade 1 is terminal-cut into a predetermined configuration by the cutters 12 to obtain a finished product of the band blade 1.

Figure 2:
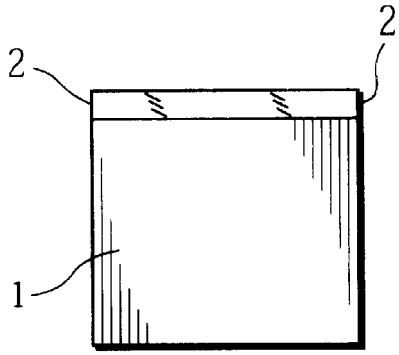
FIG. 2 is a partial front view of a band blade.
Figure 3:
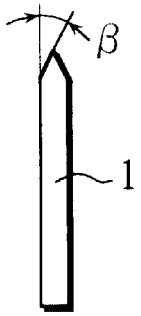
FIG. 3 is a side view of FIG. 2.
Figure 4:
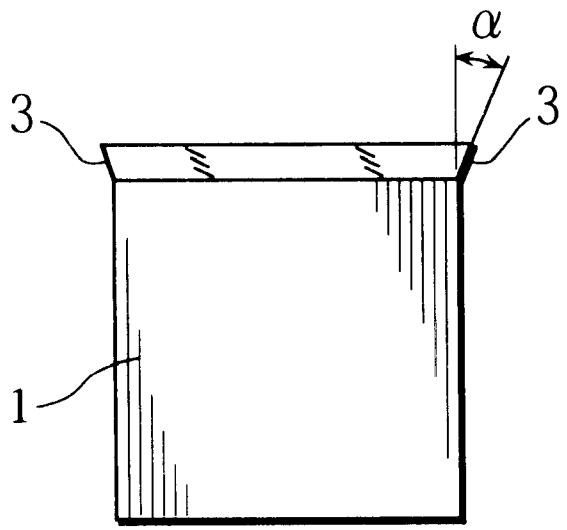
FIG. 4 is a partial front view of a band blade of another form.
Figure 5:
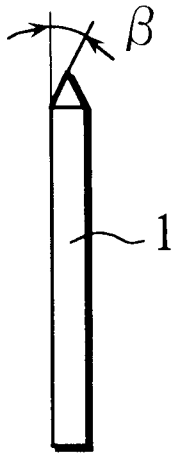
FIG. 5 is a side view of FIG. 4.
Figure 6:
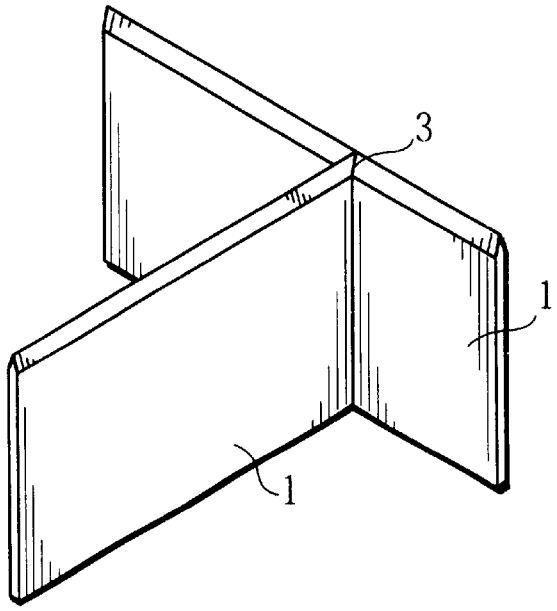
FIG. 6 is a perspective view showing a construction of the band blade.

The terminal-cut into the predetermined configuration of the band blade 1, as shown in FIGS. 2 and 4, includes a straight-cut portion 2 in FIG. 2 and a bevel portion 3 in FIG. 4 as configurations of an end or both ends of the band blade 1. The straight-cut portion 2 is formed by cutting an end portion of the band blade 1 in a direction at right angles with a longitudinal direction of the band blade 1, and the bevel portion 3 is formed by cutting an end portion of the band blade 1 in the direction at right angles with the longitudinal direction of the band blade 1 and cutting only a blade portion into a configuration with an outward inclination (with an inclination angle $\alpha$). As shown in FIG. 6, in case that another band blade 1 is connected to the band blade 1 at a middle portion, the bevel portion 3 is necessary to make the blade portions continuously connected and crossed. That is to say, the inclination angle $\alpha$ needs to correspond to an edge inclination angle β of the band blade 1. FIG. 7 shows an example of finished product which has the straight-cut portion 2, the notched portion A, the bent portion B, and the bevel portion 3 respectively formed with the notching die 14, the bender 11, and the cutter 12.

Figure 8:
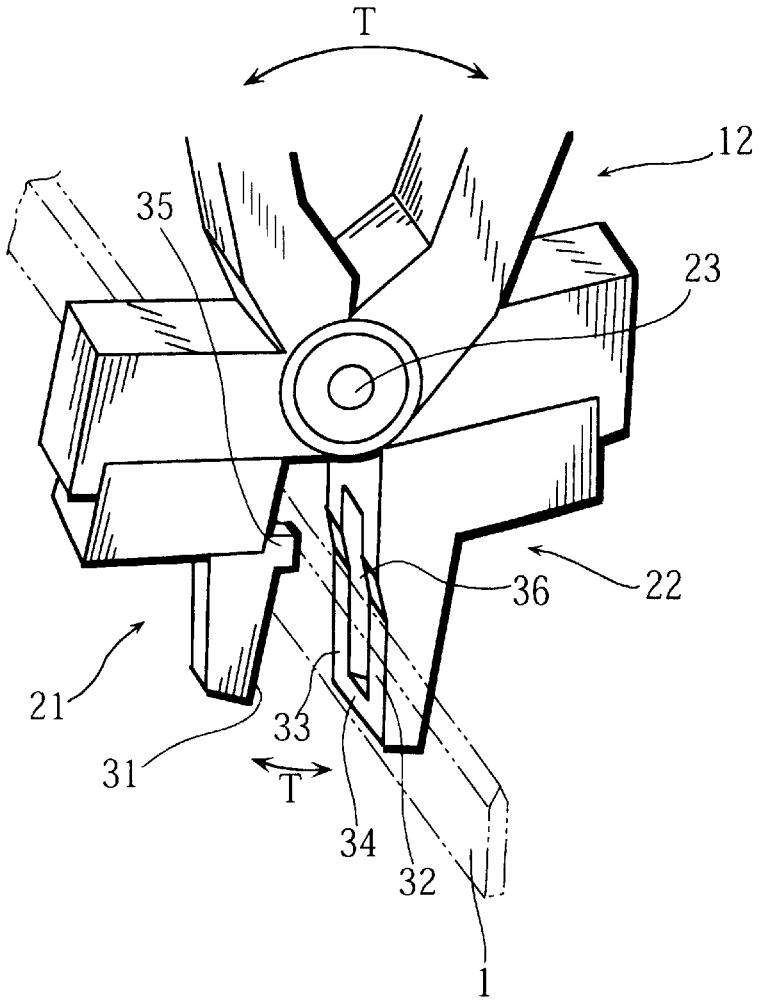
FIG. 8 is a perspective view showing composition members.

As shown in FIG. 8, the cutter 12 has a plier-shaped configuration having a male cutting portion 21 and a female cutting portion 22. And, the male cutting portion 21 is provided with a male blade 31, the female cutting portion 22 is provided with two female blades 32 and 33, and forth ends of the female blades 32 and 33 is connected through a connecting piece 34. By this construction, rigidity of the female cutting portion 22 is remarkably enhanced. The male cutting portion 21 and the female cutting portion 22 of the cutter 12 can oscillate (as shown with an arrow T) around the supporting point 23, and the band blade 1 is sheared by engagement of the male blade 31 and a gap portion 36 between the female blades 32 and 33.

Figure 9:
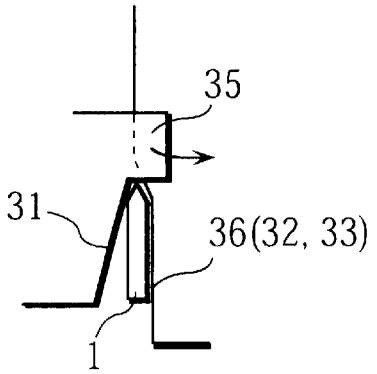
FIG. 9 is an enlarged explanatory view showing a construction of a principal portion.
Figure 10:
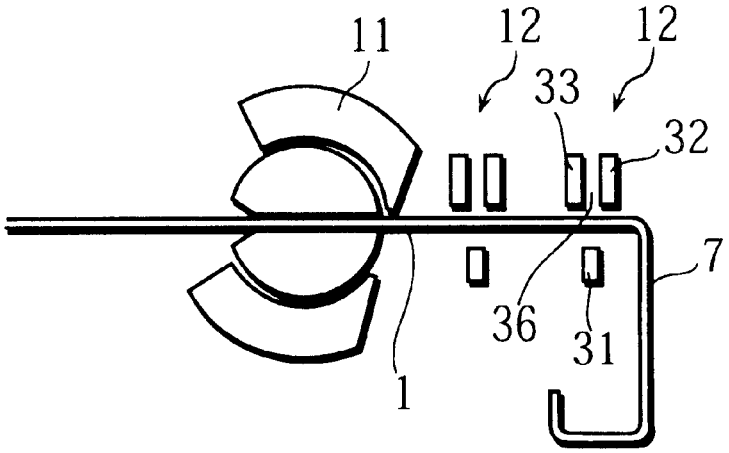
FIG. 10 is an explanatory view of composition members.
Figure 11:
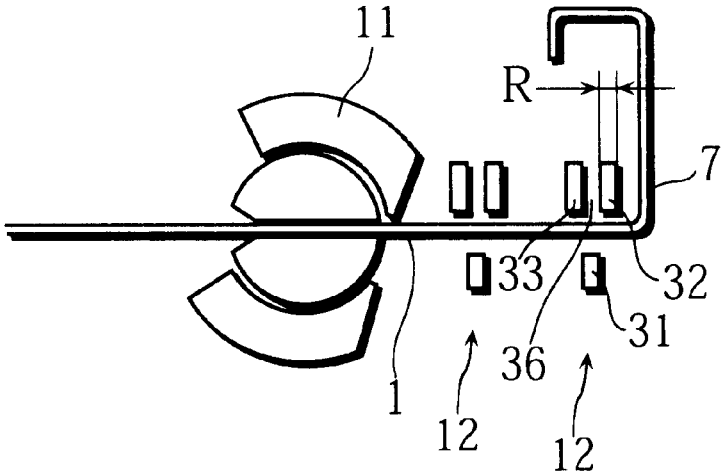
FIG. 11 is an explanatory view of composition members.

And, the male cutting portion 21 of the cutter 12 is provided with a guiding protruding piece 35 which guides the male blade 31 as to be inserted between the two female blades 32 and 33 of the female cutting portion 22 without deviation. As shown in FIG. 9, the guiding protruding piece 35 is inserted to the gap portion 36 before the male blade 31 is inserted to the gap portion 36 (to cut the band blade 1). That is to say, the guiding protruding piece 35 is previously guided into the gap portion 36, and the band blade 1 can be cut thereafter. With this guide, the blades of the cutter 12 does not deviate (twist) in cutting the band blade 1, the male blade 31 gets into the gap portion 36 first, and the band blade 1 can be cut easily with accuracy.

In the cutting with the construction of the connecting piece 34 on the forth ends of the female blades 32 and 33 and the construction of the guiding protruding piece 35 of the male cutting portion 21, the band blade 1 is hardly twisted and not damaged. For this reason, the cutter can be made small as to reduce the interference with a bend-worked product portion 7 of the band blade 1 (the end portion C in FIG. 7 can be made short). And, with the constructions above, rigidity of the female cutting portion 22 is increased as to make the blade width R of the female blades 32 and 33 narrow (thin), and the interference with the bend-worked product portion 7 of the band blade 1 is reduced (the end portion C in FIG. 7 can be made short). And, because of the small size of the cutter 12, the cutter 12 can be disposed near the bender 11 as to decrease the twist and deviation of the band blade 1, and the product is prevented from being scattered in cutting. And, plural cutters 12 may be disposed behind the bender 11 (one of the cutters 12 is for the straight-cut portion 2 and the other is for the bevel portion 3).

Figure 12:
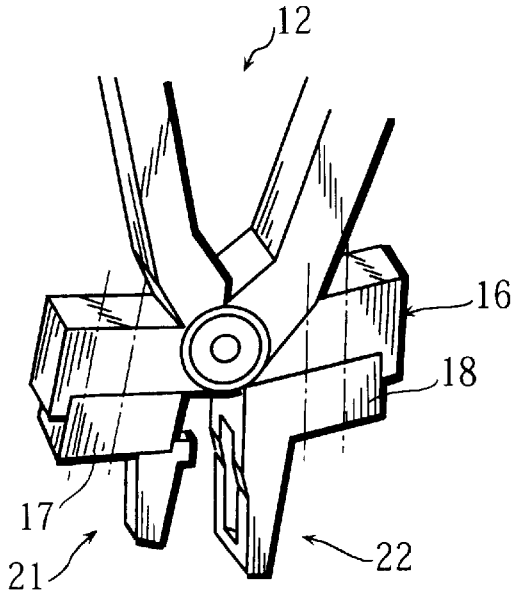
FIG. 12 is a perspective view of composition members.
Figure 13:
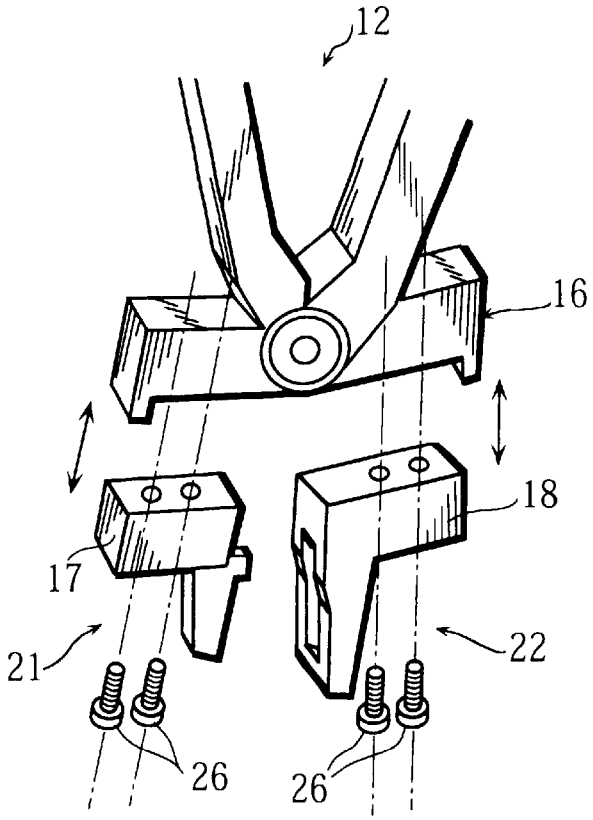
FIG. 13 is a perspective view of composition members.

And, as shown in FIG. 12 and FIG. 13, the male cutting portion 21 has a male die 17 and the female cutting portion 22 has a female die 18. The male die 17 and the female die 18 can be attached to and detached from a cutter main body 16 of the cutter 12. The male die 17 and the female die 18 respectively have plural drilled holes and counterbores, plural tapped holes (not shown in the figures) corresponding to the drilled holes are formed on the cutter main body 16, and the male die 17 and the female die 18 are bolted onto the cutter main body 16 with screws 26. FIG. 12 shows a state that the male die 17 and the female die 18 are attached, and FIG. 13 shows a state that the male die 17 and the female die 18 are detached. With this construction, blade shape of the male die 17 and the female die 18 can be changed. That is to say, one unit of the cutter 12 can easily correspond to the straight-cut portion 2 and the bevel portion 3 (FIG. 12 shows the cutter 12 for straight cut, and FIG. 13 shows the cutter 12 for beveled cut).

And, as shown in FIGS. 14 through 17, the band blade 1 is cut by the male cutting portion 21 and the female cutting portion 22 respectively moved unsymmetrically by a driving mechanism 41 and a guiding mechanism 42. As shown in FIGS. 14 through 17, the cutter 12 is connected and fixed to a cutter frame 43, and the frame 43 can be moved from a retreat position 29 to a cutting position 28 of the band blade 1 by an elevation device (not shown in the figures). That is to say, the cutter 12 for afterwork of the bender 11 retreats to a position above the band blade 1 when the bender 11 is used, and descends to the position of the band blade 1 when the cutter 12 is used. Arrows U in FIGS. 14 through 17 show directions of the elevation and the descent.

Figure 14:
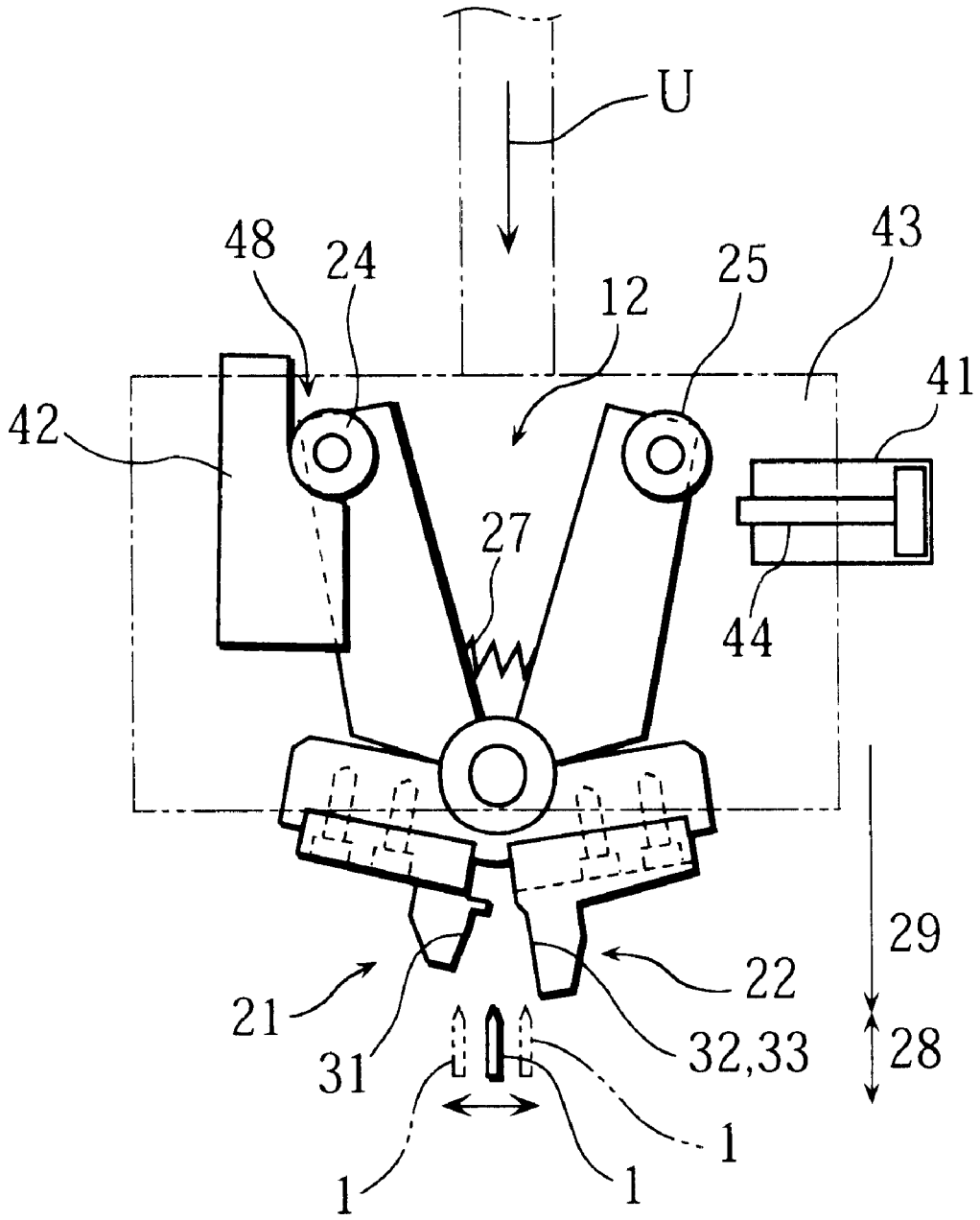
FIG. 14 is an explanatory view showing a construction of a principal portion.

In FIG. 14, the band blade 1 is in preparation of cutting. In bending, the cutter 12 retreats to an upper position (as the cutting portions 21 and 22 are on the retreat position 29) not to prevent the bending work. In preparation of cutting the band blade 1, the elevation device begins the descent of the cutter 12. A running roller 24 for the female cutting portion 22 is facing a groove 48 of the guiding mechanism 42. And, a rotation roller 25 for the male cutting portion 21 is in a free state, and the male blade 31 and the female blades 32 and 33 are wide-open by an elastic body such as a compression spiral spring 27 mounted on the cutter 12.

Figure 15:
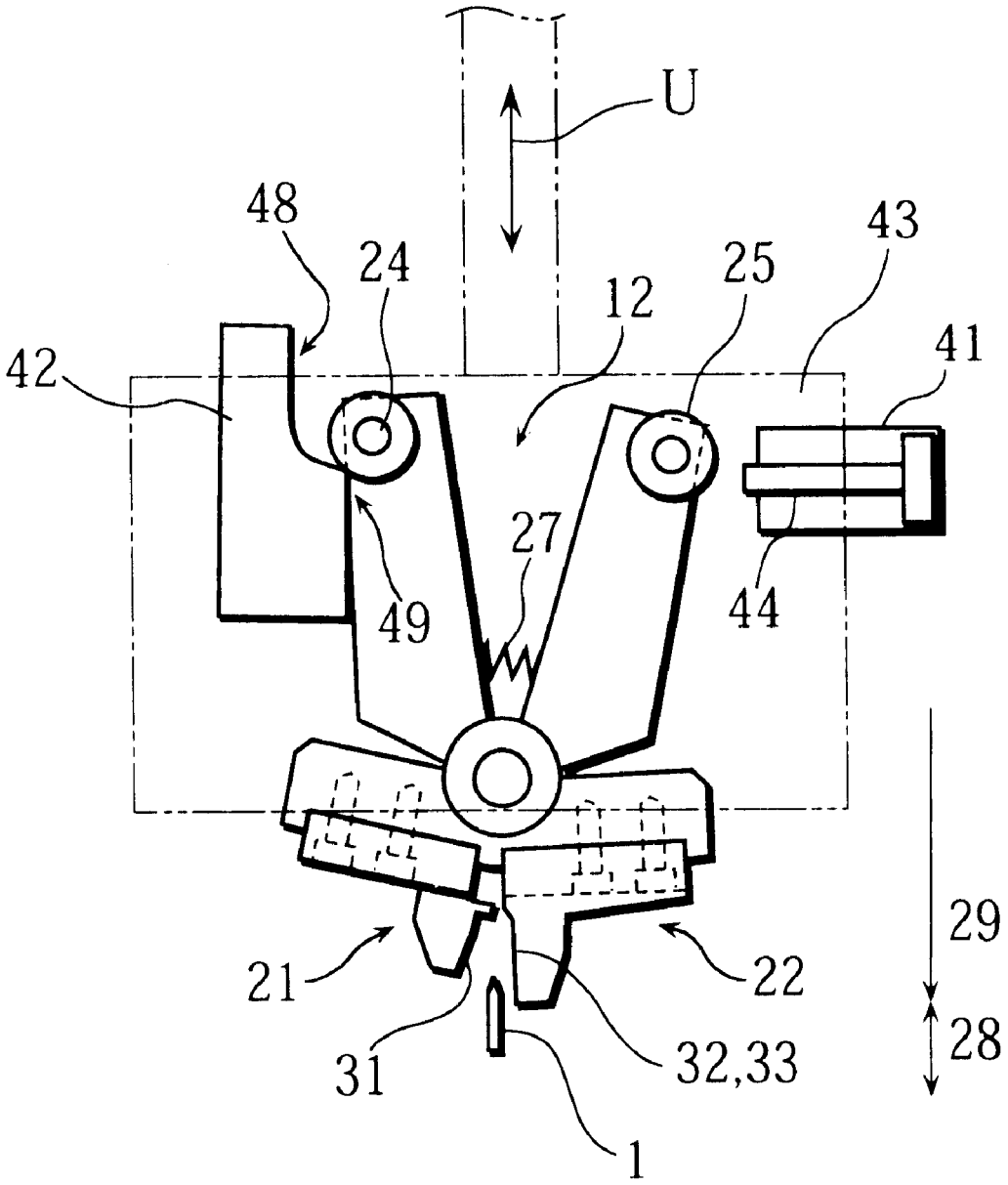
FIG. 15 is an explanatory view showing the construction of the principal portion.

FIG. 15 also shows the band blade 1 in preparation of cutting. The cutter 12 is descended lower than that in FIG. 14. The running roller 24 for the female cutting portion 22 mounts a protruding portion 49 of the guiding mechanism 42, the rotation roller 25 for the male cutting portion 21 is in the free state, and the male blade 31 and the female blades 32 and 33 come close.

Figure 16:
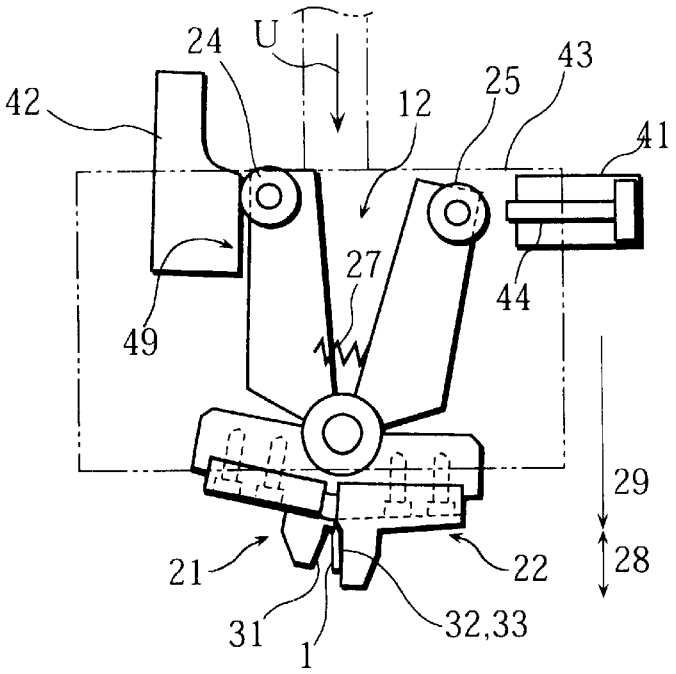
FIG. 16 is an explanatory view showing the construction of the principal portion.

FIG. 16 shows starting state of cutting. In this state, the cutter 12 is descended further by the elevation device. The running roller 24 for the female cutting portion 22 completely mounts the protruding portion 49 of the guiding mechanism 42. And, the rotation roller 25 for the male cutting portion 21 is in the free state, male blade 31 and the female blades 32 and 33 come closer, and the female blades 32 and 33 reach for a position which is facing (touching) the band blade 1 to which the bending is completed (the cutting portions 21 and 22 reach for the cutting position 28).

Figure 17:
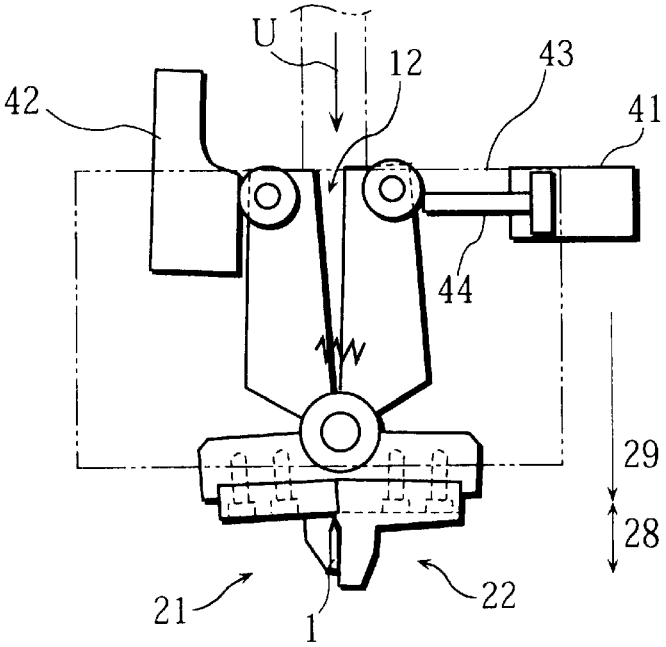
FIG. 17 is an explanatory view showing the construction of the principal portion.

FIG. 17 shows cutting state of the band blade 1. In this state, although the cutter 12 stays at the position of FIG. 16, the rotation roller 25 for the male cutting portion 21 is pushed in a compression direction of the elastic body 27 (a direction against reaction of the elastic body 27) by the driving mechanism 41 composed of an oil-hydraulic or pneumatic cylinder 44. By this movement, the male blade 31 is moved in a direction to become relatively close to the female blades 32 and 33, and the band blade 1 is cut thereby. After the cutting, the cutter 12 is retreated to the upper position (the cutting portions 21 and 22 are on the retreat position 29) by the elevation device.

As described above, the cutter 12 is wide-open by the elastic body 27 mounted on the cutter 12 while it is descended as shown in FIG. 14 because damage caused by interference of the cutter 12 with the band blade 1, which may be swaying after the bending, can be prevented when the cutter 12 is descended to the cutting position 28. And, scrap generated in the cutting is easily removed from the cutter 12.

Figure 18:
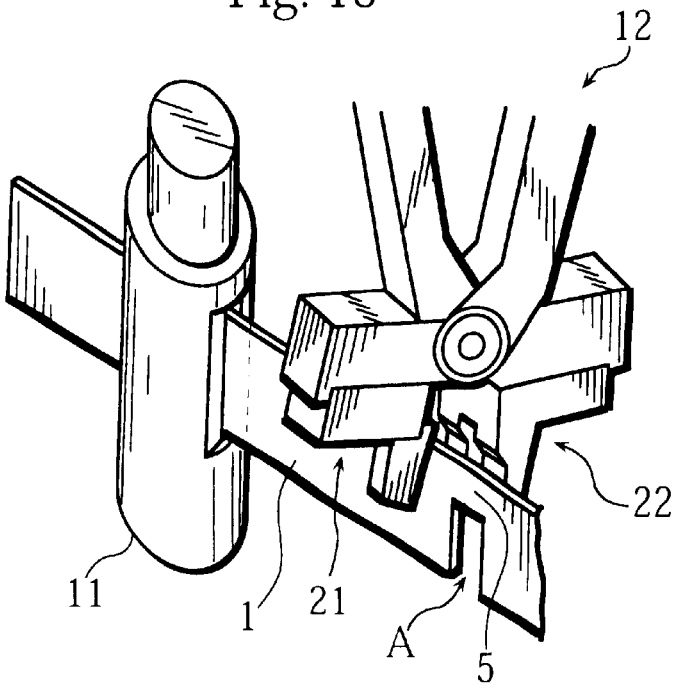
FIG. 18 is an explanatory view showing a construction of a principal portion.
Figure 19:
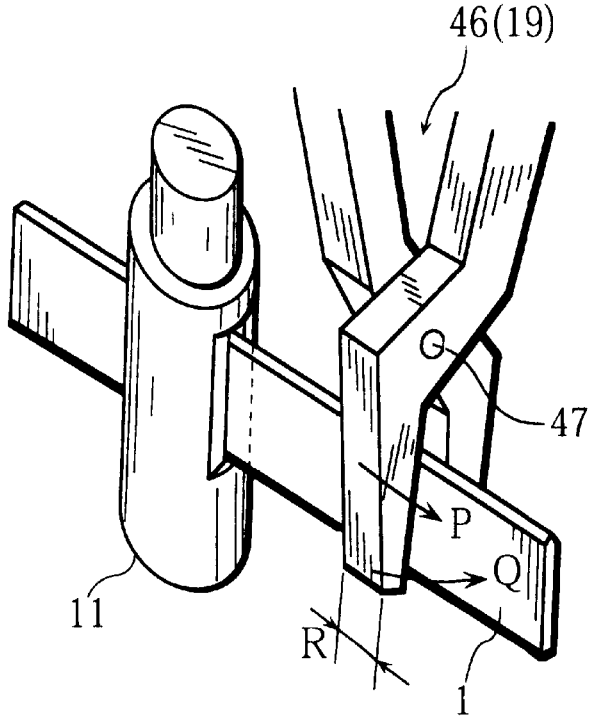
Fig. 19 PRIOR ART
FIG. 19 is an explanatory view showing a construction of a principal portion of a conventional apparatus.
Figure 20:
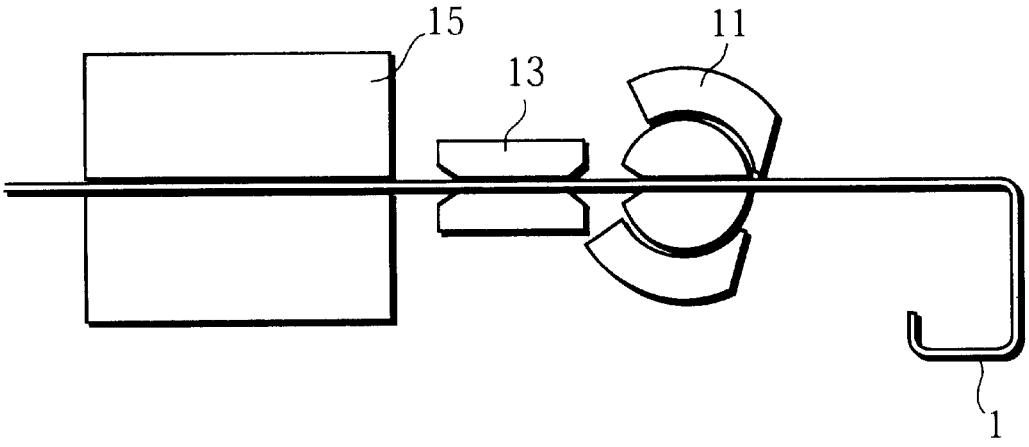
Fig. 20 PRIOR ART
FIG. 20 is a whole view showing a conventional embodiment.
Figure 21:
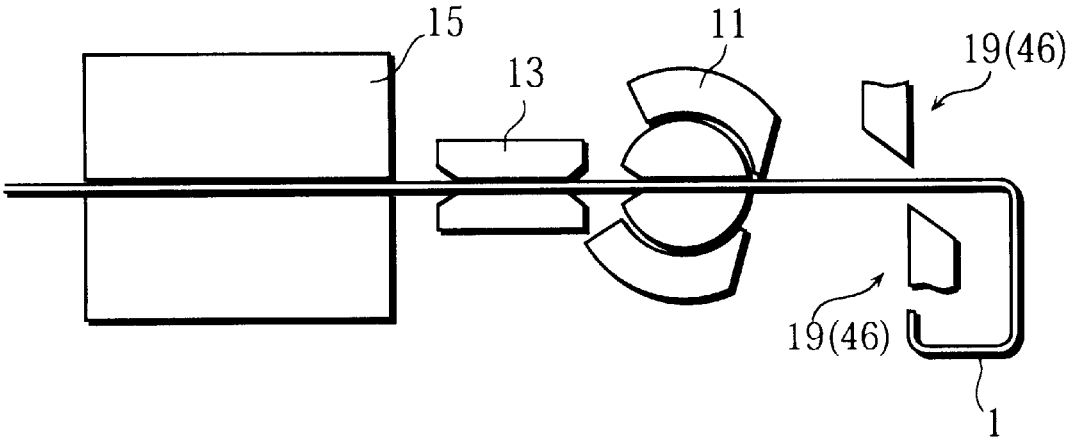
Fig. 21 PRIOR ART
FIG. 21 is a whole view showing another conventional embodiment.

And, in the cutting of the band blade 1 by the cutter 12, only a remaining portion 5 of the notched portion A, formed by the notching die 14, may be cut as shown in FIG. 18.

FIG. 1 shows a composition of the working apparatus for working and cutting the band blade 1 into a predetermined configuration. The band blade 1 of a long strip is inserted to a gap (slit) of the notching die 14 first, press-worked by the notching die having a predetermined configuration to form a notched portion A on the band blade 1 as shown in FIG. 7 (a notching process L). Next, the band blade 1 is sent through the guide 13, inserted to a gap (slit) of the bender 11, and bent by the bender 11 into a predetermined configuration (a bending process M). Then, the bent-worked band blade 1 is terminal-cut (a cutting process N) into a predetermined configuration by the cutters 12 to obtain a finished product of the band blade 1.

According to the working apparatus for band blade of the present invention, defection of edge-shape and bent-shape of the blade and damage are vanished in the bent product of the band blade 1 to improve working accuracy of the shape of the blade, halt of the apparatus caused by defective progression of the product and malfunction of the working apparatus is solved, the apparatus can be made simple, and maintenance of the apparatus can be easily conducted.

And, accuracy of the finished product can be enhanced by certain cutting of the band blade 1. Stability of the apparatus is improved because the cutter 12 itself is not damaged. And, the cutter 12 is made small to conduct working corresponding to various sizes of the finished product.

And, cutting configuration of the band blade 1 can be easily changed, and the blades (the male blade 31, the female blade 32) of the cutter 12 can be easily inspected and replaced.

Further, in cutting work, the cutter 12 and the band blade 1 are prevented from damaging each other, the band blade 1 after bending work is cut on a predetermined position, and accuracy of the product can be improved thereby.

According to the working method for band blade, the bent-worked product of the band blade 1 has no defection in edge-shape and bent-shape of the blade, halt of the apparatus caused by defective progression of the product and malfunction of the working apparatus is solved, the apparatus is made simple, and maintenance of the apparatus can be easily conducted.

While preferred embodiments of the present invention have been described in this specification, it is to be understood that the invention is illustrative and not restrictive, because various changes are possible within the spirit and indispensable features.

What is claimed is:

1. A working apparatus for band blade comprising a bender for bending a band blade into a predetermined configuration and a cutter, which is disposed successively after the bender, for cutting the band blade, wherein the cutter has a plier-shaped configuration having a male cutting portion and a female cutting portion, the male cutting portion is provided with a male blade, the female cutting portion is provided with two female blades, and forth ends of the female blades are connected with a connecting piece;

wherein the male cutting portion of the cutter is provided with a guiding protruding piece, which guides the male blade as to be inserted between the two female blades of the female cutting portion without deviation.

2. The working apparatus for band blade as set forth in claim 1, wherein the male cutting portion of the cutter is composed of a male die, the female cutting portion of the cutter is composed of a female die, and the male die and the female die are attached to and detached from a cutter main body of the cutter.

3. The working apparatus for band blade as set forth in claim 1, wherein the male cutting portion and female cutting portion of the cutter are moved unsymmetrically by a driving mechanism and a guiding mechanism while the cutter is descended.

4. A working apparatus for band blade comprising a bender for bending a band blade into a predetermined configuration and a cutter, which is disposed successively after the bender, for cutting the band blade, wherein the cutter has a plier-shaped configuration having a male cutting portion and a female cutting portion, the male cutting portion is provided with a male blade, the female cutting portion is provided with two female blades, and forth ends of the female blades are connected with a connecting piece, and wherein further the male cutting portion and the female cutting portion of the cutter are moved unsymmetrically by a driving mechanism and a guiding mechanism while the cutter is descended.

* * * * *